US007546965B1

(12) United States Patent
Parkin

(10) Patent No.: US 7,546,965 B1
(45) Date of Patent: Jun. 16, 2009

(54) DOMESTIC PLASTIC BOTTLE SHREDDER

(76) Inventor: John W. Parkin, 18 Teign Walk, Worthing, West Sussex (GB) BN13 3LR ( * ) Notice: Subject to any disclaimer, the term of this patent is extended or adjusted under 35 U.S.C. 154(b) by 131 days.

(21) Appl. No.: 11/895,304

(22) Filed: Aug. 24, 2007

(51) Int. Cl.
*B02C 19/00* (2006.01)
*B02C 23/00* (2006.01)
*B30B 9/32* (2006.01)
*B30B 3/02* (2006.01)

(52) U.S. Cl. ..... 241/99; 241/100; 100/98 R; 100/210; 100/902

(58) Field of Classification Search ..... 241/99, 241/100, 225, 243, 236; 100/95, 98 R, 902, 100/210
See application file for complete search history.

(56) References Cited

U.S. PATENT DOCUMENTS 3,703,970 A 11/1972 Benson
4,009,838 A 3/1977 Tashman
4,013,497 A * 3/1977 Wolf ..... 156/154
4,669,673 A 6/1987 Lodovico et al.
5,106,026 A 4/1992 Baron
5,150,843 A 9/1992 Miller et al.
D342,965 S 1/1994 Duke et al.
6,520,435 B1 2/2003 Robinson

* cited by examiner

*Primary Examiner*—Faye Francis

(57) ABSTRACT

The invention is a domestic plastic bottle shredding machine. The machine has a hydraulic ram assembly located above the shredding mechanism so that any plastic, glass, paper, or aluminum that is introduced will be flattened prior to being shredded. A waste bin is located beneath the shredding mechanism such that the storage process is driven by gravity. The machine is designed for domestic uses such that the shape of the machine resembles a small garbage can. The primary feature of this invention is to aid the recycling process by shredding plastic, glass, paper, or aluminum in advance of the recycling process.

5 Claims, 6 Drawing Sheets

DOMESTIC PLASTIC BOTTLE SHREDDER

CROSS REFERENCE TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of plastic shredders, more specifically a domestic plastic bottle shredder.

B. Discussion of the Prior Art

The Benson Patent (U.S. Pat. No. 3,703,970) discloses an apparatus for treating garbage and trash so that it may be reduced to a compact form in bags, blocks, or otherwise. However, the apparatus disclosed under the Benson Patent does not resemble a trash can that has all of the necessary components integrated therein for shredding plastic bottles.

The Tashman Patent (U.S. Pat. No. 4,009,838) discloses a portable solid waste shredder for automatically shredding refuse or waste materials including any kind of wet or dry trash, glass, metal cans, cartons, wood, cardboard, and synthetic plastics. However, the waste shredder disclosed under the Tashman Patent does not squeeze the trash prior to shredding, nor does it use a system for pulling bottles downward through the use of a mechanically powered guide roller assembly on one side and the use of mechanical bearings on the other side.

The Baron Patent (U.S. Pat. No. 5,106,026) discloses an apparatus, suitable for household use, for cutting and breaking empty discarded frangible containers into small pieces of material to facilitate subsequent processing and recycling of those materials. However, the apparatus disclosed under the Baron Patent does not squeeze the trash prior to shredding.

The Robinson Patent (U.S. Pat. No. 6,520,435) discloses a plastic bottle shredding device which has a catch basin on the bottom of the device. However, the shredding device disclosed under the Robinson Patent does not include a mechanism for flattening the trash prior to the shredding process.

The Miller et al. Patent (U.S. Pat. No. 5,150,843) discloses an apparatus for processing solid waste which has a hydraulic ramming device for pushing waste toward a rotary shredding assembly, after which processed waste is collected in a waste bin. However, the apparatus disclosed under the Miller Patent is not designed for domestic applications in that it does not resemble the size of a trash can. Furthermore, the apparatus uses a hydraulic ram that exerts a downward force as opposed to a horizontal force, and requires a separate chamber with conveying means to introduce the waste into the chamber where the waste is squeezed and then shredded.

The Lodovico et al. Patent (U.S. Pat. No. 4,669,673) discloses a machine that is capable of cutting disposable containers such as plastic bottles and metal cans into pieces. However, the machine disclosed under the Lodovico Patent does not have a mechanism for flattening plastic bottles in a horizontal position above the shredding mechanism. Furthermore, the machine is not suitable for domestic use, and does not resemble a small trash can.

The Duke et al. Patent (U.S. Pat. No. Des. 342,965) illustrates a design for a shredding machine for recycling, and does not illustrate the shredding means contained therein.

In light of the above discussed prior art, there is a need for a domestic plastic bottle shredding device containing a horizontal press situated above the shredding means.

BRIEF SUMMARY OF THE INVENTION

The invention is a domestic plastic bottle shredding machine. The machine has a hydraulic ram assembly located above the shredding mechanism so that any plastic, glass, paper, or aluminum that is introduced will be flattened prior to being shredded. A waste bin is located beneath the shredding mechanism such that the storage process is driven by gravity. The machine is designed for domestic uses such that the shape of the machine resembles a small garbage can. The primary feature of this invention is to aid the recycling process by shredding plastic, glass, paper, or aluminum in advance of the recycling process.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
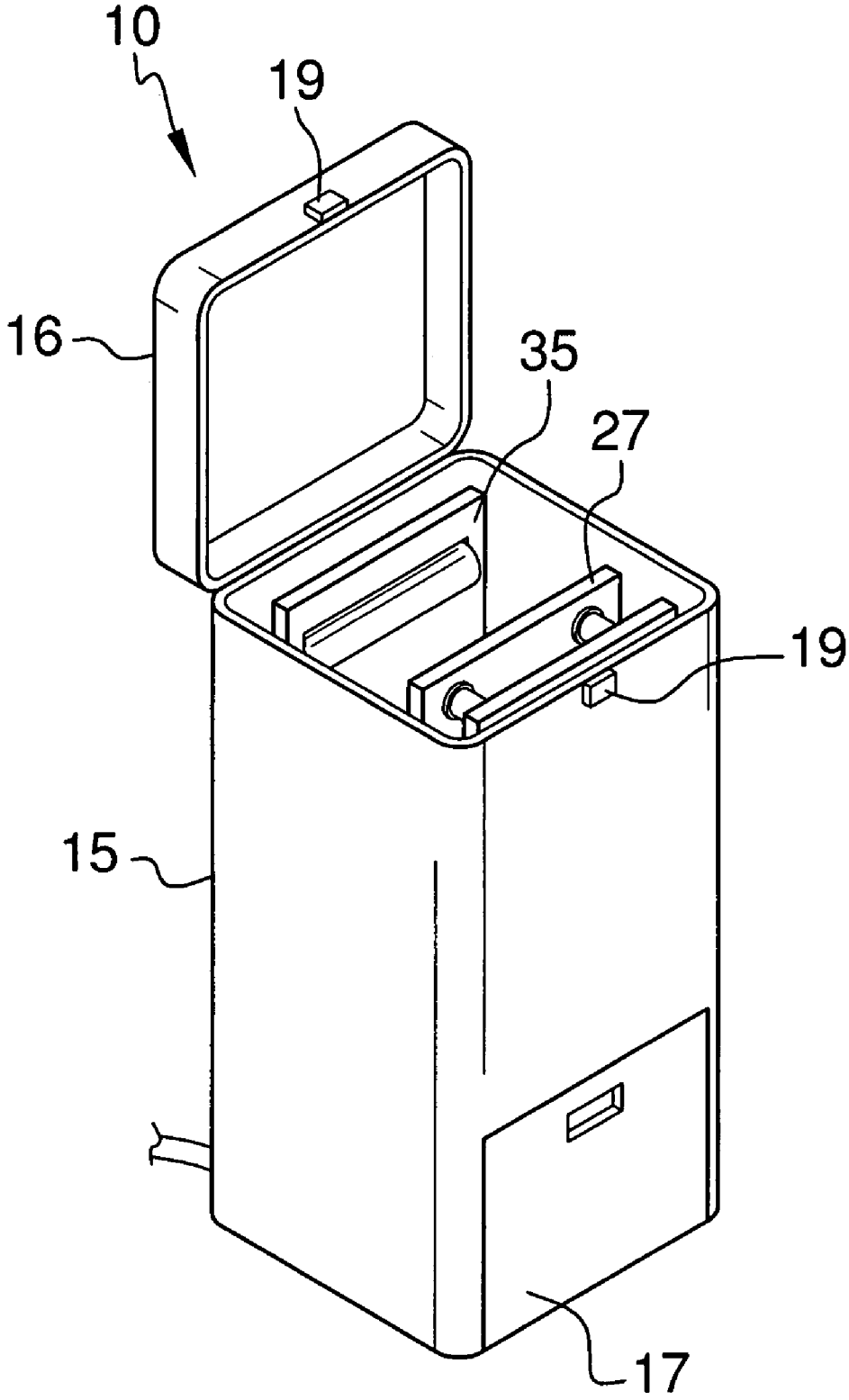
FIG. 1 illustrates an isometric view of the invention with the top lid in the open position.

Detailed reference will now be made to the preferred embodiments of the present invention, examples of which are illustrated in FIGS. 1-6. A plastic bottle shredding machine 10 (hereinafter machine) includes a housing 15, a top lid 16, and a removable trash bin 17. The top lid 16 is hingedly connected to the housing 15 by a hinge 18. Located at a predetermined location on both the top lid 16 and the housing 15 is a micro switch 19. Located at a predetermined location on the top lid is an ON/OFF switch 20. The trash bin 17 has a handle 21 for removing and installing the trash bin 17.

Figure 3:
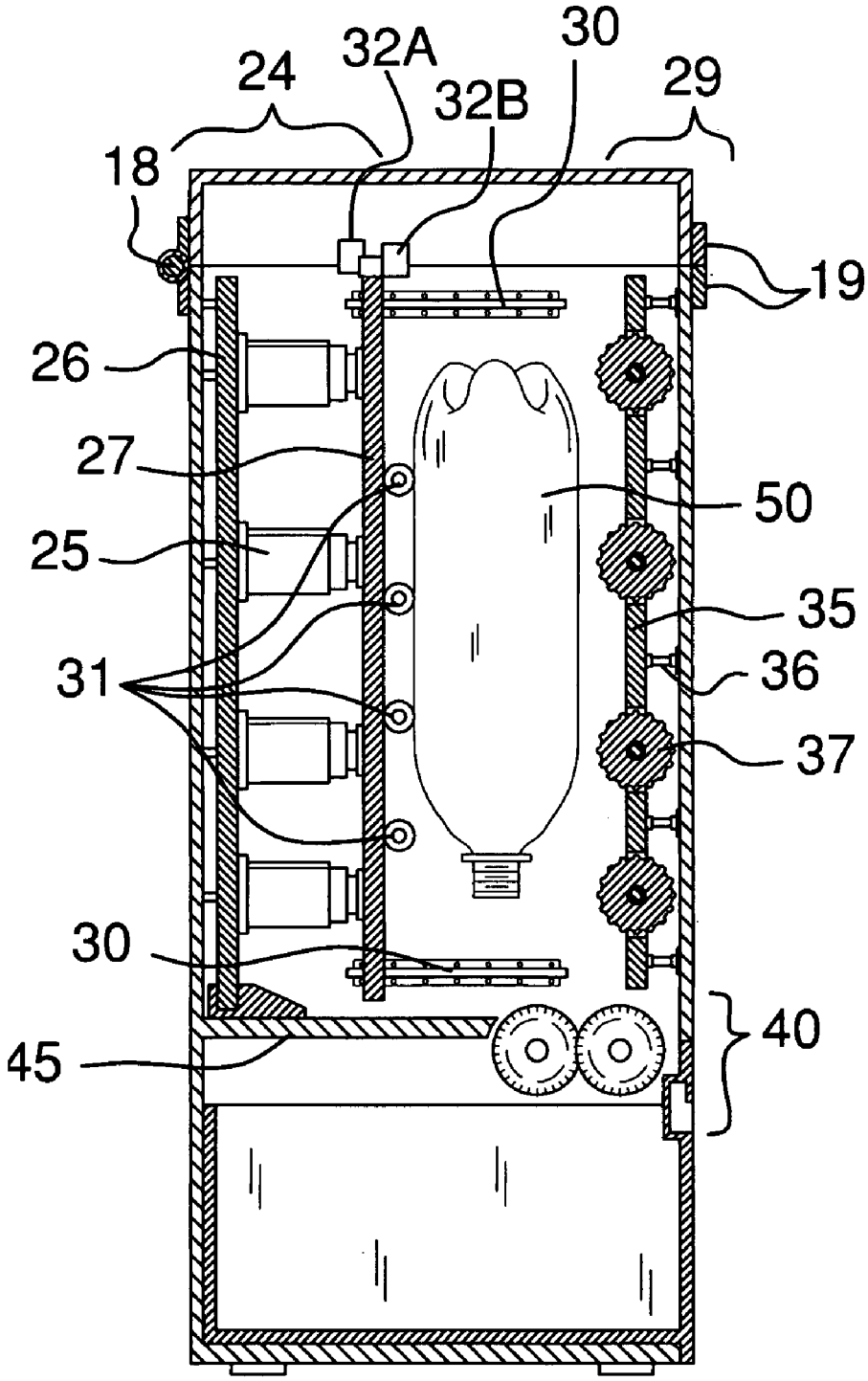
FIG. 3 illustrates a cross-sectional view of the invention along line 3-3 with the hydraulic ram assembly in a retracted position.
Figure 4:
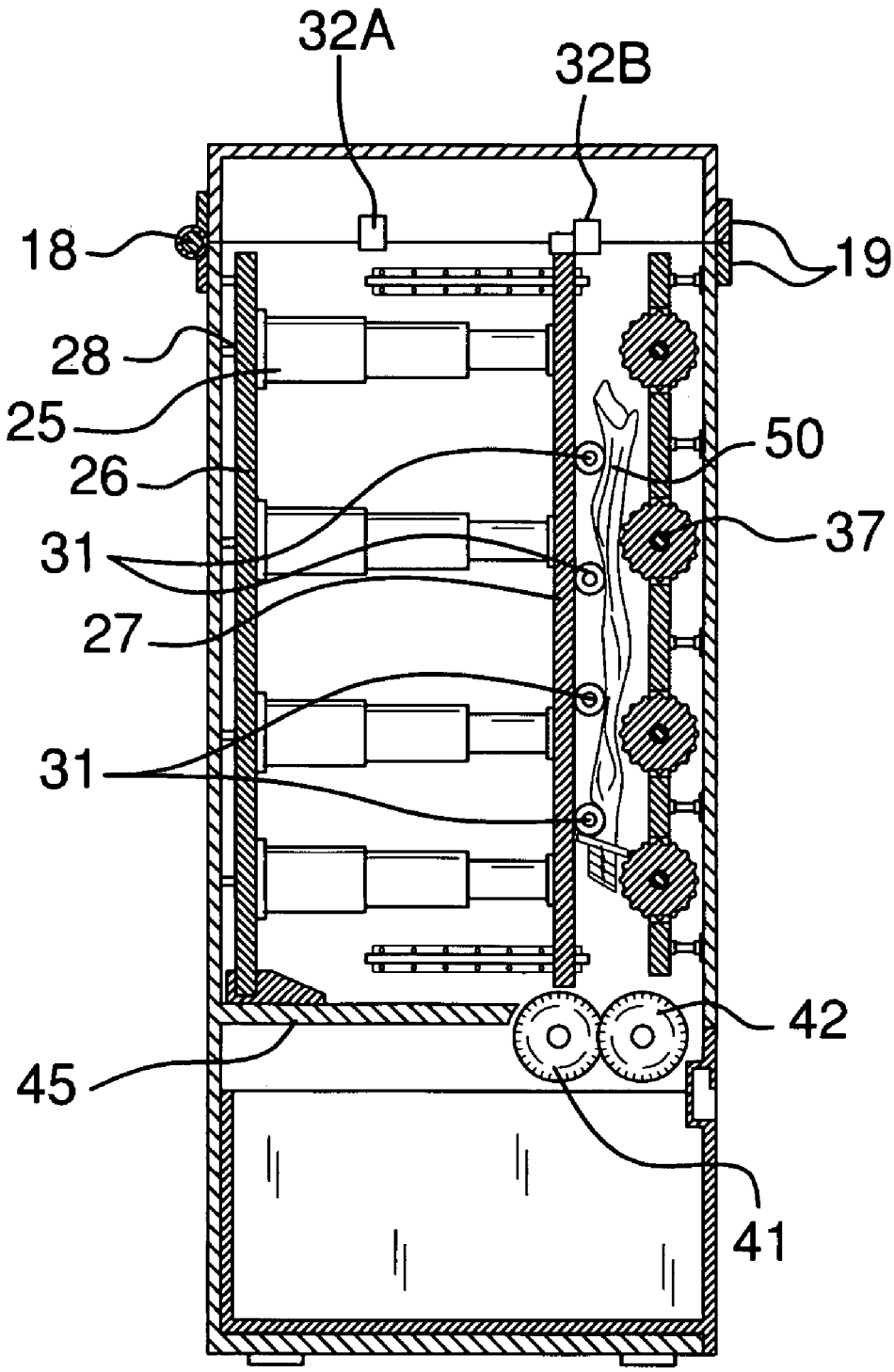
FIG. 4 illustrates a detailed cross-sectional view of the invention along line 3-3 with the hydraulic ram assembly in an expanded state crushing a plastic bottle.
Figure 5:
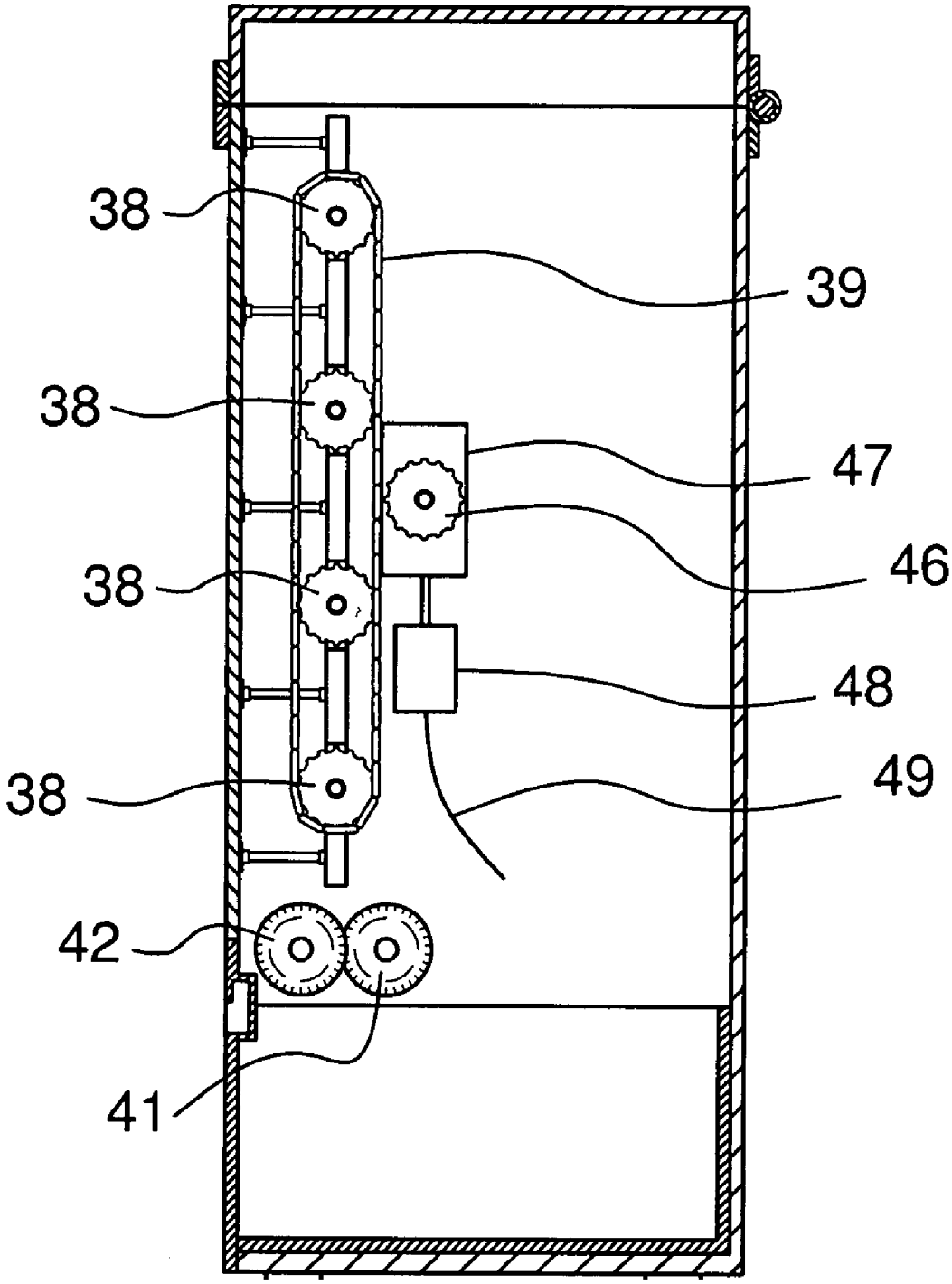
FIG. 5 illustrates a detailed view of the mechanical drive means for the guide roller assembly.

Located inside of the housing 15 is a hydraulic ram assembly 24 that consists of a plurality of hydraulic rams 25 that are mounted to a hydraulic ram mounting plate 26. Attached to the ends of the hydraulic rams 25 is a ram plate 27, which is the surface that comes into contact with a plastic bottle 50, as depicted in FIGS. 3 and 4. The hydraulic ram mounting plate 26 is attached to the interior surface of the housing 15 by a plurality of hydraulic ram assembly mounting fasteners 28.

Located along the interior surface of the housing 15 is a plurality of ram plate guides 30. The ram plate guides 30 are designed to guide the ram plate 27 laterally within the interior of the housing 15.

Mounted to the surface of the ram plate 27 is a plurality of roller bearings 31. The roller bearings 31 are designed to aid in the introduction of the plastic bottle 50. The roller bearings 31 can rotate independent of each other, and each roller bearing 31 can rotate with or without respect to the direction that the plastic bottle 50 travels as it descends down through the invention 10. It shall be noted that both the rollers 31 and the ram plate 27 come into contact with the plastic bottle 50.

It shall be noted that the hydraulic rams 25 may be powered by either a hydraulic power system (not shown) or by an electrical jack system that does not use a hydraulic fluid.

Located inside of the housing 15 and correspondingly adjacent to the hydraulic ram assembly 24 is a guide roller assembly 29. The guide roller assembly 29 consists of a plurality of guide rollers 37 that are attached to a guide roller plate 35 that is attached to the interior surface of the housing 15 by a plurality of guide roller assembly mounting fasteners 36. The guide rollers 37 rotate downwards enabling the invention to push the plastic bottle 50 downwards toward a shredding mechanism 40.

The guide roller assembly 29 is powered by a power cord 49 attached to a motor 48 which transfers power to a gear reducer 47. The gear reducer 47 has attached to it's output a gear reducer chain sprocket 46. The gear reducer chain sprocket 46 moves a chain 39, which in turn rotates a plurality of chain sprockets 38. The chain sprockets 38 are securely positioned to a roller plate 35, but may rotate freely. Each chain sprocket is connected to the corresponding guide roller 37, which are depicted in FIGS. 3 and 4.

Located within the interior of the housing 15 and below both the hydraulic ram assembly 24 and the guide roller assembly 29 is the shredding mechanism 40. The shredding mechanism 40 consists of a pair of rotating shredding blades 41 and 42 that complement one another such that when both blades rotate, the plastic bottle 50 will be shredded into many small pieces of plastic. The rotating shredding blades 41 and 42 are driven by a gear reducer (not shown), which is driven by an electrical motor (not shown). It shall be noted that the shredding mechanism shall be capable of shredding paper products, plastic, glass, and or aluminum cans.

Located adjacent to the rotating shredding blades 41 and 42 is a separation wall 45, which is integrated into the interior design of the housing 15. The separation wall 45 ensures that the small shredded pieces do not get behind the ram plate 27 and interfere with the mechanical components of the hydraulic rams 25.

Located within the interior of the housing 15 and below both the rotating shredding blades 41 and 42 and the separation wall 45 is the region of the housing 15 that accommodates the removable trash bin 17.

Exiting the housing 15 is an electrical cord 55, which is wiredly connected to and provides electricity for the various electrical components of the invention 10.

Figure 2:
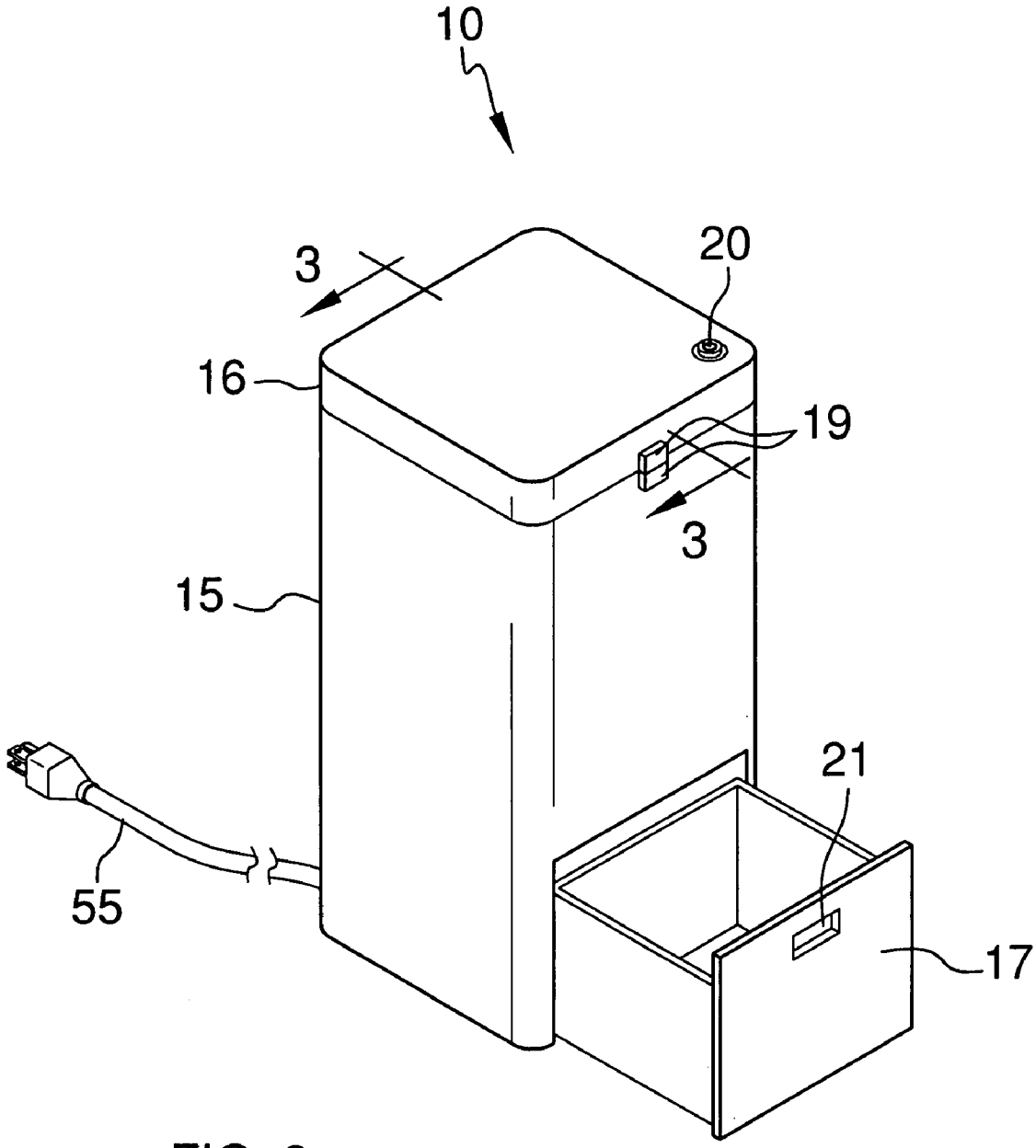
FIG. 2 illustrates an isometric view of the invention with the top lid in the closed position and the trash bin pulled out.

The machine 10 works by closing the lid 16 to a "closed position" 60, as depicted in FIGS. 2-4, which activates the micro switch 19. Upon which the end user depressed the ON/OFF switch 20, which in turn directs the hydraulic ram assembly 24 to extend to an "extended position" as depicted in FIG. 4. The hydraulic ram assembly 24 stops extending when a micro-switch sensor 32A makes contact with a ram plate micro-switch 32B. Simultaneously, electrical power is delivered to the shredding mechanism 40.

Figure 6:
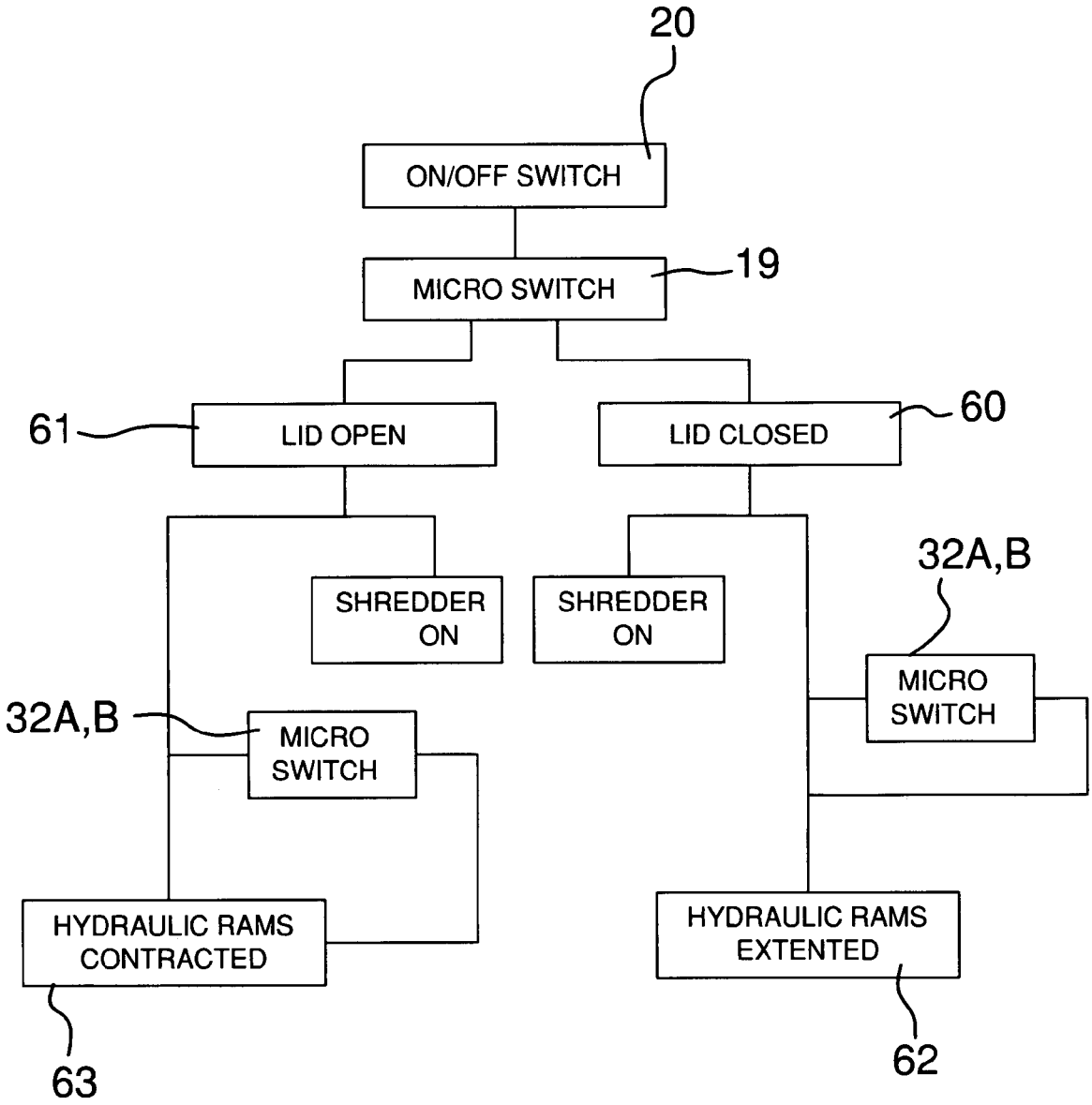
FIG. 6 illustrates a power diagram for the various electrical components of the invention.

When the lid 16 is opened to an "open position" 61, as depicted in FIG. 1 and labeled as such in FIG. 6, the hydraulic ram assembly 24 is directed to retract to a "contracted position" 63, as depicted in FIG. 3 and labeled as such in FIG. 6. The hydraulic ram assembly 24 stops contracting when the micro-switch sensor 32A makes contact with the ram plate micro-switch 32B. However, electrical power continues to be supplied to the shredding mechanism 40.

Electrical power ceases when the ON/OFF switch 20 is depressed a second time. This feature enables the end user to continue to add more plastic bottles 50 after the prior bottles are shredded, so that the end user does not have to turn on the shredding mechanism 40 each time another plastic bottle 50 is introduced into the machine 10.

Once the removable trash bin 17 is filled, the end user simple removes and empties the removable trash bin 17, and thereafter places the removable trash bin 17 back into the prescribed place in the machine 10.

An alternative embodiment of the present invention would be to include proximity sensors (not shown) inside of the housing 15 and at predetermined locations between the guide rollers 37 and the ram plate 27, such that after the ram plate is in the "extended position" 62 and when the plastic bottle is consumed by the shredding mechanism 40, the proximity sensors (not shown) will direct the hydraulic ram assembly 24 to return to the "contracted position" 63.

Another alternative embodiment of the present invention, which is not shown, would include another micro-switch 19 (not shown) that would be attached to the trash bin 17 and to the interior of the housing 15. The micro-switch 19 (not shown) is designed to go off when the trash bin 17 is opened, and will cease all electricity of all components contained in the invention 10.

It shall be noted that variations and alternatives of the present embodiment including equivalent structures and structural equivalents are readily apparent to those of ordinary skill in the art upon reading present disclosure, and such variations and alternatives are incorporated in the invention unless otherwise expressly indicated in the claims.

The inventor claims:

1. A domestic plastic bottle shredding machine comprising:

(a) a housing;

(b) a lid;

wherein the lid is hingedly attached to the housing by a hinge;

wherein a ON/OFF switch is located along a predetermined position on the lid;

(c) a micro switch;

wherein the micro switch has components permanently mounted at predetermined locations to both the lid and the housing;

(c) a removable trash bin;

wherein a handle is incorporated along the upper front portion of the front side of the removable trash bin;

wherein the removable trash bin is located near the bottom of the housing and collects debris internally descending to the bottom of the housing;

wherein a micro-switch is located along a side of the trash bin and adjacently to an interior portion of the housing for the purpose of shutting off electricity when the micro-switch makes and sends a signal;

(d) a hydraulic ram assembly;

wherein the hydraulic ram assembly is located along the upper interior portion of the housing;

wherein a hydraulic ram mounting plate is permanently attached to an interior surface of the housing by a plurality of hydraulic ram assembly mounting fasteners;

wherein a plurality of hydraulic rams are permanently mounted to the hydraulic ram mounting plate;

wherein a ram plate is connected to the opposite end of the hydraulic rams;

wherein a plurality of roller bearings are attached to the ram plate and provided rotational support to any refuse being inserted into the machine for shredding;

wherein the plurality of roller bearings may move independent of each other;

wherein the hydraulic rams are driven by a hydraulic oil that is circulated in a hydraulic oil system comprising a hydraulic oil reservoir that is connected to a hydraulic pump, and where the output of the hydraulic pump is connected via a high-pressure line to all of the hydraulic rams;

wherein the hydraulic ram assembly is situated within the interior of the housing such that the directional movement of the hydraulic rams is parallel with the ground;

(e) a guide roller assembly;

wherein a guide roller plate is permanently attached to an interior surface of the housing by a plurality of guide roller assembly mounting fasteners;

wherein a plurality of guide rollers are mounted to the guide roller plate such that the guide rollers can rotate with respect to the guide roller plate;

wherein the guide roller assembly is parallel to and corresponds with the hydraulic ram assembly;

wherein the guide rollers are propelled by chain sprockets;

wherein the chain sprockets are attached to the roller plate and guide rollers;

wherein the chain sprockets are propelled by a chain driven system consisting of a chain, a gear reducer, a chain sprocket attached to the output of the gear reducer, and a motor attached to the input of the gear reducer;

(f) a shredding mechanism;

wherein the shredding mechanism is located within the interior of the housing and below both the hydraulic ram assembly and the guide roller assembly;

wherein the shredding mechanism consists of a pair of rotating blades that complement each other;

wherein the shredding blades are rotated by a gear reducer, which is powered by a motor; and (g) a separation wall;

wherein a separation wall is integrated into the interior design of the housing and is adjacent to the shredding mechanism; and wherein the separation wall prevents shredded plastic pieces from entering the mechanical components of the hydraulic ram assembly.

2. The domestic plastic bottle shredding machine of claim 1 wherein the hydraulic rams of the hydraulic ram assembly consists of electrical jacks that are driven by a plurality of electrical motors that are individually attached to each jack or one electrical motor that drives all jacks in concert via a belt and gear reducing assembly.

3. The domestic plastic bottle shredding machine of claim 1 wherein the motor of the guide roller assembly is electrically powered or wherein the motor is removed and the gear reducer of the guide roller assembly is hydraulically powered by a hydraulic fluid that is pressurized by a hydraulic pump.

4. The domestic plastic bottle shredding machine of claim 1 wherein the motor of the shredding mechanism is electrically powered or wherein the motor is removed and the gear reducer is hydraulically powered by a hydraulic fluid that is pressurized by a hydraulic pump.

5. The domestic plastic bottle shredding machine of claim 1 wherein the shredding mechanism is capable of shredding paper products, plastic bottles, glass products, and aluminum cans.

* * * * *